United States Patent [19]

Jones

[11] 4,206,070

[45] Jun. 3, 1980

[54] DETERGENT COMPOSITIONS

[75] Inventor: Kenneth L. Jones, Cincinnati, Ohio

[73] Assignee: The Procter & Gamble Company, Cincinnati, Ohio

[21] Appl. No.: 904,656

[22] Filed: May 10, 1978

Related U.S. Application Data

[63] Continuation of Ser. No. 644,214, Dec. 24, 1975, abandoned.

[51] Int. Cl.[2] ..... C11D 1/722; C11D 1/83

[52] U.S. Cl. ..... 252/174.21; 252/117; 252/351; 252/DIG. 1; 252/DIG. 14; 252/559; 252/95

[58] Field of Search ..... 252/89, DIG. 1, DIG. 14, 252/522, 559, 161, 117, 351; 260/615 R, 615 B

[56] References Cited

U.S. PATENT DOCUMENTS

| | | | |
|---|---|---|---|
| 2,900,346 | 8/1959 | Fowkes et al. | 252/161 X |
| 3,282,843 | 11/1966 | Alburger | 252/351 X |
| 3,427,248 | 2/1969 | Lamberti et al. | 252/117 |

*Primary Examiner*—Mayer Weinblatt
*Attorney, Agent, or Firm*—Robert B. Aylor; Richard C. Witte; Thomas H. O'Flaherty

[57] ABSTRACT

A mixture of certain alkyl glyceryl ethers with ethoxylated nonionic surfactants provides a surfactant combination having a particularly good ability to remove greasy and oily materials from fabrics of many kinds.

21 Claims, No Drawings

DETERGENT COMPOSITIONS

This is a continuation of application Ser. No. 644,214, filed Dec. 24, 1975, now abandoned.

BACKGROUND OF THE INVENTION

This invention relates to detergent compositions and, in particular, to detergent compositions which comprise, in combination, an alkyl glyceryl ether and an ethoxylated nonionic surfactant.

Conventional detergent compositions have adequate cleaning performance in most situations. However, one major problem area which remains is the removal of greasy and oily materials from fabrics. This problem is particularly pronounced with certain of the newer synthetic fabrics and is also particularly serious in the case of hydrocarbon-based oils such as used motor oil. There is therefore a clear need to improve the performance of detergent compositions in terms of grease and oil removal.

It has been recognized that nonionic surfactants can offer certain advantages in this area, and the incorporation of surfactants such as ethoxylated alcohols into detergent compositions does provide some benefit in oily stain removal. Unfortunately, this benefit does not extend to a wide spectrum of fabric/oily stain combinations and, in particular, removal of hydrocarbon oil stain, especially on cotton, tends to be difficult.

It is an object of the present invention to provide a particular combination of surfactant materials which offers improved performance on oily stain removal through the wash.

DESCRIPTION OF THE PRIOR ART

Alkyl glyceryl ethers are known materials and various uses have been suggested for them. For example, they have been suggested as fixing agents for perfumes in U.S. Pat. No. 2,091,162; as superfatting agents in soap in U.S. Pat. No. 2,157,022; and as extracting agents for organic substances in U.S. Pat. No. 2,156,724.

Furthermore, these and related materials have been suggested for use in detergent compositions for certain purposes. U.S. Pat. No. 2,768,956, issued Oct. 20, 1956 to Scott, discloses acylaryl glyceryl ethers in detergent compositions containing ionic non-soap surfactants. The glyceryl ethers in this case are said to be suds stabilizers. U.S. Pat. No. 2,900,346, issued Aug. 18, 1959 to Fowkes and Sawyer, also discloses the utility of glyceryl ethers as foam stabilizers for ionic, particularly sulfate and sulfonate, surfactants. U.S. Pat. No. 3,427,248, issued Feb. 11, 1969 to Lamberti et al, discloses the use of certain higher alkyl polyol ethers in combination with detergents as suds boosters and lime scum dispersants.

The utilization of naturally-occurring glyceryl ethers such as selachyl alcohol and batyl alcohol is discussed by M. Sulzbacher in Manufacturing Chemist, 1962, 33, 232 and it is suggested that these materials could have surface activity and could be made water-compatible by ethoxylation of the hydroxyl groups.

Concurrently filed U.S. Application Ser. No. 644,271, entitled DETERGENT COMPOUNDS AND COMPOSITIONS, by K. L. Jones, now abandoned relates to certain novel glyceryl ethers of ethoxylated alcohols which are themselves surfactants and are useful in detergent compositions.

None of the above discussed art references have recognized the particularly beneficial effect on greasy and oily soil removal obtained by using compositions of the present invention comprising a combination of an alkyl glyceryl ether and a specific type of nonionic surfactant.

SUMMARY OF THE INVENTION

According to the invention, there is provided a detergent composition comprising a combination consisting essentially of (a) from 80% to 20% by weight of monoglyceryl ether of the general formula $$R-OCH_2-\underset{\underset{OH}{|}}{CH}-CH_2OH$$

wherein R is a substantially linear alkyl or alkenyl moiety having from 8 to 16 carbon atoms, and (b) from 20% to 80% by weight of a nonionic surfactant which is a condensation product of a $C_9$–$C_{15}$ alcohol with an alkylene oxide selected from ethylene oxide and mixtures of ethylene oxide and said nonionic surfactant having a hydrophile-lipophile balance greater than about 10, and preferably greater than about 12.

Detergent compositions according to the invention can also include other surfactants, for example anionic or zwitterionic surfactants, builders and other conventional detergent additives.

DETAILED DESCRIPTION OF THE INVENTION

Binary Active System

Compositions of the present invention comprise, in combination, two essential ingredients, a monoglyceryl ether and an ethoxylated nonionic surfactant, which together form a binary active system affording excellent oily stain removal characteristics.

While not intending to be limited by theory, it is postulated that the linearity and the relatively strong intermolecular hydrogen bonding afforded by the hydrophilic, compact vicinal diol end group of the monoglyceryl ether result in enhanced grease/oil removal through the reduction of oil-water interfacial tension. The presence of the nonionic surfactant serves in part to solubilize the monoglyceryl ether so that it can reach the oil-water interface from aqueous solution and in part to assist in the removal of an oily stain. It is important that the nonionic surfactant be carefully selected so that it is fully compatible with the glyceryl ether. For example, nonionic surfactants having highly branched hydrophobic groups tend not to pack well at an oil/water interface with the glyceryl ether. It is therefore desirable that the nonionic surfactant has a substantially linear chain.

The monoglyceryl ether of the present invention has the general formula $$R-OCH_2-\underset{\underset{OH}{|}}{CH}-CH_2OH$$

where R is a substantially linear alkyl or alkenyl moiety having from 8 to 16 carbon atoms. Preferably, R is a $C_8$–$C_{12}$ alkyl moiety, most preferably decyl, undecyl, or dodecyl.

The monoglyceryl ethers of alkanols are known materials and can be prepared, for example, by the condensation of a higher alkanol with glycidol.

The alkyl monoglyceryl ethers are lipophilic in character and, especially at alkyl chain lengths above 10 carbon atoms in length, have insufficient water solubility to act as useful surfactants in aqueous solutions.

In combination with certain alkoxylated nonionic surfactants, however, the alkyl monoglyceryl ethers adsorb very effectively from aqueous solution at an oil-water interface.

The alkoxylated nonionic surfactants for use in the present invention are preferably based on a substantially straight-chain hydrocarbon moiety. The term "substantially straight chain" is intended to include within its scope the chain structure of alcohols prepared by the oxo process, which conventionally have up to about 25% of $C_1$–$C_3$ side chains at the 2-position.

The alkoxylate moiety of the nonionic surfactant is preferably polyethylene oxide, but can also be mixtures of oxides of ethylene and propylene.

In every case, the balance between the hydrocarbon moiety and the alkoxylate moiety must be such that the hydrophilic-lipophilic balance (HLB) is greater than about 10 and preferably greater than 12.

Especially suitable nonionic surfactants are the condensation products of substantially straight chain aliphatic alcohols with ethylene oxide. Examples of such ethoxylated alcohols include the condensation product of about 10 moles of ethylene oxide condensed with 1 mole of myristyl alcohol, the condensation product of about 6 moles of ethylene oxide with 1 mole of coconut fatty alcohol where the coconut alcohol is a mixture of $C_{10}$–$C_{14}$ alkanols, and the condensation product of about 9 moles of ethylene oxide with 1 mole of the above-described coconut alcohol.

Highly preferred surfactants are those based on synthetic alcohols prepared by the oxo process. Such alcohols are mixtures of primary alcohols having up to about 25% of the of the mixture with methyl branching at the carbon atom adjacent to the hydroxyl-substituted carbon atom. The ethoxylated alcohols marketed by The Shell Chemical Company under the trade names Neodol or Dobanol are of this type. Very highly preferred examples are the stripped (see below) condensation products of 7 moles of ethylene oxide with 1 mole of a $C_{14}$-$C_{15}$ alcohol (Neodol 45-7), 8 moles of ethylene oxide with 1 mole of a $C_9$–$C_{11}$ alcohol (Dobanol 91-8) and 6.5 moles of ethylene oxide with 1 mole of a $C_{12}$–$C_{13}$ alcohol (Neodol 23-6.5).

Other useful surfactants are based on the secondary alcohols marketed by The Union Carbide Corporation under the trade name Tergitol. Tergitol 15-S-9, a condensation product of 9 moles of ethylene oxide with an average $C_{15}$ alcohol, is a suitable example.

For best results, it is preferred that the ethoxylated alcohol is "stripped", i.e., is made substantially free of unethoxylated alcohol and low ethoxylate materials. It will be understood that the normal base-catalyzed ethoxylation process tends to produce a widely distributed range of ethoxylates averaging out at the derived product. The stripped ethoxylates have a relatively narrow distribution of ethoxylate content. In the present specification, the term "stripped condensation product of 7 moles of ethylene oxide with 1 mole of a $C_{14}$–$C_{15}$ alcohol," for example, means the product formed by ethoxylating 1 mole of $C_{14}$–$C_{15}$ alcohol with 7 moles of ethylene oxide and subsequently removing substantially all of the unethoxylated alcohol and the low ethoxylates (e.g., mono- and di- ethoxylates).

The ratio of nonionic surfactant to monoglyceryl ether can be varied over a wide range of from 4:1 to 1:4. Highly preferred embodiments are those where the ratio is from 4:1 to 1:1, especially 7:3 to 1:1.

The binary surfactant system of the present invention can be used as the sole surfactant system of a detergent composition, in which case the composition can include conventional ingredients of detergent compositions, such as builders, bleaches, anti-redeposition agents, enzymes, etc. Such detergent compositions have particular utility for removal of greasy and oily stains.

The binary surfactant system can also be combined with co-surfactants, for example nonionic or zwitterionic surfactants, or non-ethoxylated nonionic surfactants to provide detergent compositions having an oily soil removal benefit.

Co-surfactants

Co-surfactants useful in detergent compositions of the present invention are selected from anionic, non-ethoxylated nonionic, zwitterionic and ampholytic surfactants. Most useful compositions are obtained when the binary nonionic system is combined with anionic or zwitterionic surfactants.

The ratio of co-surfactant:binary nonionic system can range from 10:1 to 1:10, preferably 4:1 to 1:1, especially about 2:1.

Examples of the above types of co-surfactants are listed in U.S. Pat. No. 3,862,058 of Nirschl and Gloss, the disclosure of which is incorporated herein by reference.

Particularly useful anionic surfactants include $C_8$–$C_{18}$ alkyl sulfates and sulfonates; ($C_9$–$C_{20}$ alkyl) benzene sulfonates, especially sodium or alkanolamine salts of linear straight chain alkyl benzene sulfonates in which the average chain length of the alkyl group is from 10 to 14, especially about 11.8 carbon atoms (normally abbreviated $NaC_{11.8}LAS$); alkyl ether sulfates of the formula $$R\ O(C_2H_4O)_n\ SO_3M$$

wherein R is $C_{10}$–$C_{20}$ alkyl or alkenyl, n is 1–30 and M is an alkali metal cation; and olefin sulfonates derived by the sulfomation of $C_{12}$–$C_{24}$ $\alpha$-olefins with sulfur trioxide.

While the binary surfactant system of the present invention can offer an oily soil removal benefit when combined with any anionic surfactant, especially efficacious compositions for combating grease and oil stains are provided by combining the binary surfactant system with alkaline earth metal, preferably magnesium or calcium, salts of linear alkyl benzene sulfonic acid. The preferred material for this purpose is $Mg(C_{11.4}LAS)_2$. Ratios of $Mg(LAS)_2$:binary nonionic system from 4:1 to 1:1, preferably about 2:1, are especially useful.

Nonionic surfactants are less useful in conjunction with the binary system which itself contains a specific type of nonionic surfactant. However, non-ethoxylate-containing materials such as amine oxides, phosphine oxides and sulfoxides may be used in this context. Specific examples of such surfactants include dimethyldodecylamine oxide, dimethylstearylamine oxide, bis-(2-hydroxyethyl) dodecylamine oxide, dimethyldodecylphosphine oxide, dodecylmethyl sulfoxide and octadecyl methyl sulfoxide.

Preferred zwitterionic surfactants include higher alkyl or alkaryl ammonio propane sulfonates, such as 3-(N,N-dimethyl-N-hexadecylammonio) propane-1-sulfonate, 3-(N,N-dimethyl-N-hexadecylammonio)-2-hydroxy propane-1-sulfonate and 3-(N,N-dimethyl-N-alkylammonio-2-hydroxy propane-1-sulfonate, the alkyl group being devised from middle cut coconut fatty alcohol, and higher alkyl or alkaryl ammoniocarboxylates such as (N-dodecylbenzyl-N,N-dimethyl ammonio) acetate, (N,N-dimethyl-N-hexadecylammonio) acetate and 6-(N-dodecylbenzyl-N,N-dimethylammonio) hexanoate. Other useful zwitterionic materials are the ethoxylated ammonio-sulfonates and sulfates disclosed in U.S. Patent Application Ser. No. 493,953, filed Aug. 1, 1974.

Builder Salts

Detergent compositions of the present invention preferably include builder salts, especially alkaline, polyvalent anionic builder salts. These alkaline salts serve to maintain the pH of the laundry solution in the range from about 7 to about 12, preferably from 8 to 11.

Suitable detergent builder salts useful herein can be of the poly-valent inorganic or poly-valent organic types, or mixtures thereof. Non-limiting examples of suitable water-soluble, inorganic alkaline detergent builder salts include the alkali metal carbonates, borates, phosphates, polyphosphates, bicarbonates, silicates and sulfates. Specific examples of such salts include the sodium and potassium tetraborates, perborates, bicarbonates, carbonates, tripolyphosphates, orthophosphates and hexametaphosphates.

Examples of suitable organic alkaline detergency builder salts are: (1) water-soluble amino polyacetates, e.g., sodium and potassium ethylenediamine tetraacetates, nitrilotriacetates and N-(2-hydroxyethyl) nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic poly-valent anionic builder salts are preferred for use herein from an economic standpoint, the ammonium, alkanolammonium, e.g., triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate and trisodium ethane-1-hydroxy-1,1-diphosphonate.

While any of the foregoing alkaline poly-valent builder materials are useful herein, sodium tripolyphosphate, sodium nitrilotriacetate, sodium mellitate, sodium citrate and sodium carbonate are preferred herein for this builder use. Sodium tripolyphosphate is especially preferred herein as a builder both by virtue of its detergency builder activity and its ability to suspend illite and kaolinite clay soils and retarding their redeposition on the fabric surface.

Another type of detergency builder material useful in the present composition comprises a water-soluble material capable of forming a water-insoluble reaction product with water hardness cations in combination with a crystallization seed which is capable of providing growth sites for said reaction product. Such "seeded builder" compositions are fully disclosed in Belgian Pat. No. 798,856, issued Oct. 29, 1973, the disclosure of which is incorporated herein by reference.

Specific examples of materials capable of forming the water-insoluble reaction product include the water-soluble salts of carbonates, bicarbonates, sesquicarbonates, silicates, aluminates, and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, inventor Bauman, issued Jan. 28, 1969, incorporated herein by reference.

The complex aluminosilicates, i.e., zeolite-type materials, are useful presoaking/washing adjuvants herein in that these materials soften water, i.e., remove $Ca^{++}$ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference.

The detergent builders are used at concentrations of from about 10 percent to about 60 percent, preferably 20 percent to 50 percent, by weight of the detergent compositions of this invention.

Other Components

In addition to the above-described surfactant or builder components, the present compositions can optionally contain a wide variety of other conventional detergency adjuncts. Representative materials of this type include, for example, the various anticaking agents, filler materials, soil suspending agents such as carboxymethylcellulose, anti-spotting agents, dyes, perfumes, suds boosters, suds depressants and the like. These adjunct materials are commonly used as minor components (e.g., 0.1% to 5% wt.) in compositions of the present type.

Highly preferred optional additives herein include various bleaches commonly employed in presoak, laundry additive and detergent compositions. Such bleaches can include, for example, the various organic peroxyacids such as peradipic acid, perphthalic acid, diperphthalic acid, diperazelaic acid and the like. Inorganic bleaches, i.e., persalts including such materials as sodium perborate, sodium perborate tetrahydrate, urea peroxide, and the like, can be employed in the compositions herein. Bleaches are commonly used in the instant granular compositions at a level of from about 1% to about 45% by weight.

An especially preferred bleaching agent for use herein is sodium perborate tetrahydrate, at an effective concentration of from about 10% to about 30% by weight of the total composition.

Liquid or pasty compositions, in particular, can include materials to impart alkalinity to the detergent solution; typical of such materials are mono-, di- and tri-ethanolamine.

Various detergency enzymes well known in the art for their ability to degrade and aid in the removal of various soils and stains can also be employed in the present granular compositions. Detergency enzymes are commonly used at concentrations of from about 0.1% to about 1.0% by weight of such compositions. Typical enzymes include the various proteases, lipases, amylases, and mixtures thereof, which are designed to remove a variety of soils and stains from fabrics.

Composition Preparation

Compositions of the present invention can be prepared in any of a wide variety of product forms, for example as granules, powder, liquid, gel, paste or tablets. Where a solid product form is desired, a granular composition is generally preferred and slurry comprising a builder salt such as sodium tripolyphosphate and the surfactant system can be spray-dried to form granules. Alternatively, the product may be agglomerated, and this is preferred with certain nonionic surfactants which are relatively low-boiling and may degrade during spray drying.

In especially preferred compositions, the product is prepared in liquid form. Liquid products are very useful for grease removal as they can be used neat as a pretreatment for oily stains. In liquid formulations, the surfactant mixture is normally dissolved in water or a water-alcohol mixture, preferred alcohols being $C_1$–$C_3$ alkanols, especially ethanol. In liquid formulations, particularly preferred co-surfactants are the magnesium, calcium, triethanolammonium and monoethanolammonium salts of LAS.

Generally, the total surfactant level in compositions of the present invention ranges from about 2% to about 95% by weight. Surfactant levels tend to be relatively high, from 30% to 50%, in liquid compositions and relatively low, from 10% to 20%, in granular compositions. Lower surfactant concentrations, for example from 2% to 10%, can be useful when the composition is designed for use without dilution. Compositions in the form of pastes or gels can have very high surfactant concentrations, up to 95%.

Performance Testing

The oily stain removal performance of the binary active mixture of the present invention was tested by comparison with a single nonionic surfactant.

Cotton fabric cloths were artificially stained with a grease/oil stain and the cloths were washed in water of 7 grain hardness at 100° F. in the presence of 300 ppm of surfactant. The control surfactant in all cases was Neodol 45-7, a condensate of 7 moles of ethylene oxide with one mole of a $C_{14}$–$C_{15}$ alcohol. The cloths, after washing, were visually graded by a panel of judges and the percentage stain removal was estimated.

In the results detailed below, the improvement in percentage stain removal over the control is recorded.

(a) Ratio of nonionic:alkyl glyceryl ether

| % Stripped Dobanol 91-8 | % $C_{10}$ Alkyl Glyceryl Ether | % Stain Removal Improvement |
|---|---|---|
| 90 | 10 | −3 |
| 75 | 25 | +12 |
| 60 | 40 | +19 |
| 50 | 50 | +18 |

(b) Type of Nonionic

Binary mixtures of 60% nonionic surfactant and 40% of $C_{10}$ alkyl glyceryl ether were tested.

| Nonionic | HLB (approx.) | % Stain Removal Improvement |
|---|---|---|
| Dobanol 91-12 | 16 | +11.5 |
| Stripped Dobanol 91-8 | 14 | +16 |
| Neodol 45-7 | 12 | +11 |
| Neodol 23-3 | 10 | +10 |

(c) Chain length of alkyl glyceryl ether

Binary mixtures of 60% of stripped Dobanol 91-8 and 40% of various chain length alkyl glyceryl ethers were tested.

| Chain Length | % Stain Removal Improvement |
|---|---|
| $C_8$ | −3 |
| $C_{8.5}$ | +4 |
| $C_9$ | +4 |
| $C_{10}$ | +19 |
| $C_{8-10}$ | +9 |
| $C_{9-11}$ | +16 |

The following Examples illustrate compositions of the present invention.

EXAMPLE I

Granular detergent compositions were prepared having the following formulae:

| | Compositions (wt. %) | |
|---|---|---|
| | A | B |
| Stripped Dobanol 91-8 | 9.0 | 5.5 |
| $C_{10}$ alkyl glyceryl ether | 9.0 | 5.5 |
| Sodium carbonate | 10.0 | 10.0 |
| Sodium silicate (1.6 ratio $SiO_2$:$Na_2O$) | 10.0 | 8.0 |
| Sodium tripolyphosphate | 24.4 | 32.0 |
| Bentonite | 6.0 | 5.0 |
| Sodium sulfate | 25.0 | 24.0 |
| Moisture and minors | to 100 | to 100 |

The above compositions A and B were tested for soil removal by comparison with compositions identical except for the replacement of the binary active mixture by the same amount of a single nonionic surfactant (stripped Neodol 23-3).

The exemplified compositions were significantly better in their removal of greasy and oily stains and were not significantly different in their removal of clay soil.

EXAMPLE II

| | Compositions (wt. %) | | | |
|---|---|---|---|---|
| | A | B | C | D |
| $Mg(C_{11.4}LAS)_2$ | 30 | 30 | | |
| Monoethanolammonium $C_{11.4}LAS$ | | | 18 | 18 |
| Stripped Dobanol 91-8 | 10 | | 22 | |
| Condensate product of 9 moles of ethylene oxide with 1 mole of a $C_{13}$—$C_{14}$ secondary alcohol | | 10 | | 22 |
| $C_{10}$ alkyl glyceryl ether | 5 | | 11 | |
| $C_{9-11}$ alkyl glyceryl ether | | 5 | | 11 |
| Triethanolamine | 3 | 3 | | |
| Monoethanolamine | | | 2 | 2 |
| Oleic acid | 2 | 2 | 1 | 1 |
| Ethanol | 5 | 5 | 5 | 5 |
| Water and minors | ---------- to 100 ---------- | | | |

The above heavy-duty liquid detergent compositions provided effective oily stain removal when used as a main wash detergent.

What is claimed is:

1. A detergent composition consisting essentially of:
(1) from about 2% to about 95% of a binary surfactant system consisting essentially of:
(a) from 80% to 20% by weight of monoglyceryl ethers of the general formula $$R-OCH_2-\underset{\underset{OH}{|}}{CH}-CH_2OH$$

wherein R is a substantially linear alkyl or alkenyl moiety having from 8 to 16 carbon atoms, and
(b) from 20% to 80% by weight of a nonionic surfactant which is a condensation product of a $C_9$–$C_{15}$ alcohol with an alkylene oxide selected from ethylene oxide and mixtures of ethylene oxide and propylene oxide, said nonionic surfactant having a hydrophile-lipophile balance greater than 10;

the balance being optional components selected from the group consisting of:
(2) from 10 to 60% detergency builders;
(3) from 0 to 5% anticaking agents;
(4) from 0 to about 5% filler materials;
(5) from 0 to about 5% soil-suspending agents;
(6) from 0 to about 5% anti-spotting agents;
(7) from 0 to about 5% dyes;
(8) from 0 to about 5% perfumes;
(9) from 0 to about 5% suds boosters;
(10) from 0 to about 5% suds depressants;
(11) from 0 to about 45% bleach;
(12) from 0 to about 1% detergency enzymes;
(13) from 0 to about 98% alkalinity sources;
(14) from 0 to about 98% water; and
(15) from 0 to about 98% water and $C_1$–$C_3$ alkanol mixtures.

2. A composition according to claim 1 wherein R is $C_8$–$C_{12}$ alkyl.

3. A composition according to claim 1 containing from 10% to about 60% of a detergency builder.

4. A composition according to claim 3 wherein the detergency builder is selected from the group consisting of alkali metal carbonates, alkali metal borates, alkali metal phosphates, alkali metal polyphosphates, alkali metal bicarbonates, alkali metal silicates, alkali metal sulfates, water-soluble aminopolyacetates, water-soluble salts of phytic acid, water-soluble polyphosphonates, alkali metal salts of mellitic acid, zeolite-type aluminosilicate materials, and mixtures thereof.

5. A composition according to claim 1 wherein the nonionic surfactant is a condensation product of ethylene oxide with a substantially straight chain $C_9$–$C_{15}$ aliphatic alcohol.

6. A composition according to claim 5 wherein the ratio of the monoglyceryl ether to the nonionic surfactant is from 1:4 to 1:1.

7. A composition according to claim 6 wherein said ratio is from 3:7 to 1:1.

8. A composition according to claim 7 wherein the hydrophilic-lipophilic balance of the nonionic surfactant is greater than 12.

9. A composition according to claim 8 wherein the nonionic surfactant is selected from the stripped condensation products of 7 moles of ethylene oxide with 1 mole of a $C_{14}$–$C_{15}$ alkanol, of 8 moles of ethylene oxide with 1 mole of a $C_9$–$C_{11}$ alkanol and of 6.5 moles of ethylene oxide with 1 mole of a $C_{12}$–$C_{13}$ alkanol.

10. A composition according to claim 8 wherein the R group of the monoglyceryl ether is $C_8$–$C_{12}$ alkyl.

11. A detergent composition consisting essentially of:
(1) from about 2% to about 95% of a mixture of:
(a) a binary surfactant system consisting essentially of
(i) from 80% to 20% by weight of monoglyceryl ethers of the formula $$R-OCH_2-\underset{\underset{OH}{|}}{CH}-CH_2OH$$

wherein R is a substantially linear alkyl or alkenyl moiety having from 8 to 16 carbon atoms, and
(ii) from 20% to 80% by weight of a nonionic surfactant which is a condensation product of a $C_9$–$C_{15}$ alcohol with an alkylene oxide selected from ethylene oxide, and mixtures of ethylene oxide and propylene oxide, said condensation product having a hydrophile-lipophile balance greater than 10; and
(b) a co-surfactant selected from the group consisting of water-soluble anionic, non-ethoxylated nonionic, ampholytic and zwitterionic surfactants; the ratio of (a) to (b) being from 10:1 to 1:10;

the balance being optional components selected from the group consisting of:
(2) from 10 to about 60% detergency builders;
(3) from 0 to about 5% anticaking agents;
(4) from 0 to about 5% filler materials;
(5) from 0 to about 5% soil-suspending agents;
(6) from 0 to about 5% anti-spotting agents;
(7) from 0 to about 5% dyes;
(8) from 0 to about 5% perfumes;
(9) from 0 to about 5% suds boosters;
(10) from 0 to about 5% suds depressants;
(11) from 0 to about 45% bleach;
(12) from 0 to about 1% detergency enzymes;
(13) from 0 to about 98% alkalinity sources;
(14) from 0 to about 98% water; and

(15) from 0 to about 98% water and $C_1$–$C_3$ alkanol mixtures.

12. A composition according to claim 11 wherein the co-surfactant is selected from the group consisting of alkali metal ammonium and alkanolammonium salts of ($C_9$–$C_{20}$ alkyl) benzene sulfonic acid, $C_8$–$C_{18}$ alkyl sulfonates, $C_8$–$C_{18}$ alkyl sulfates, olefin sulfonates derived from $C_{12}$–$C_{24}\alpha$-olefins and ($C_{10}$–$C_{20}$ alkyl) ether sulfates.

13. A composition according to claim 11 wherein the ratio of (a) to (b) is from 1:4 to 1:1.

14. A composition according to claim 13 wherein the nonionic surfactant of the binary surfactant system is a condensation product of ethylene oxide with a substantially straight chain $C_9$–$C_{15}$ aliphatic alcohol and has a hydrophile-lipophile balance of greater than about 12.

15. A composition according to claim 14 wherein the ratio of the monoglyceryl ether to the nonionic surfactant in the binary surfactant system is from 1:4 to 1:1.

16. A composition according to claim 15 wherein the R group of the monoglyceryl ether is $C_8$–$C_{12}$ alkyl.

17. A composition according to claim 11 wherein the co-surfactant is selected from the group consisting of calcium and magnesium salts of alkyl benzene sulfonic acid having from 10 to 14 carbon atoms in the alkyl chain.

18. A composition according to claim 17 wherein the ratio of (a) to (b) is from 1:4 to 1:1.

19. A composition according to claim 18 wherein the ratio of the monoglyceryl ether to the nonionic surfactant in the binary surfactant system is from 1:4 to 1:1.

20. A composition according to claim 19 wherein the nonionic surfactant is selected from the stripped condensation products of 7 moles of ethylene oxide with 1 mole of a $C_{14}$–$C_{15}$ alkanol, of 8 moles of ethylene oxide with 1 mole of a $C_9$–$C_{11}$ alkanol and of 6.5 moles of ethylene oxide with 1 mole of a $C_{12}$–$C_{13}$ alkanol.

21. A composition according to claim 20 wherein the ratio of (a) to (b) is about 1:2.

* * * * *